US007597095B2

(12) United States Patent
Grace, Jr. et al.

(10) Patent No.: US 7,597,095 B2
(45) Date of Patent: Oct. 6, 2009

(54) DROP-AWAY ARROW REST

(75) Inventors: Louis Grace, Jr., North Street, MI (US); Nathaniel E. Grace, Port Huron, MI (US)

(73) Assignee: Grace Engineering Corp., Memphis, MI (US)

( * ) Notice: Subject to any disclaimer, the term of this patent is extended or adjusted under 35 U.S.C. 154(b) by 238 days.

(21) Appl. No.: 11/690,418

(22) Filed: Mar. 23, 2007

(65) Prior Publication Data

US 2007/0221186 A1 Sep. 27, 2007

Related U.S. Application Data

(60) Provisional application No. 60/784,940, filed on Mar. 23, 2006.

(51) Int. Cl.
*F41B 5/22* (2006.01)

(52) U.S. Cl. ..... 124/44.5

(58) Field of Classification Search ..... 124/24.1, 124/44.5

See application file for complete search history.

(56) References Cited

U.S. PATENT DOCUMENTS 4,685,439 A * 8/1987 Cosentino, Jr. ..... 124/44.5
4,803,971 A 2/1989 Fletcher
4,865,007 A 9/1989 Saunders
5,365,912 A * 11/1994 Pittman ..... 124/44.5
5,415,154 A 5/1995 Angeloni
6,044,832 A 4/2000 Piersons, Jr.
6,202,635 B1 * 3/2001 Evans ..... 124/44.5
6,595,195 B1 7/2003 Barner et al.
6,615,813 B1 9/2003 Troncoso, Jr. et al.
6,634,110 B2 10/2003 Johnson
6,688,297 B1 2/2004 Clague
6,739,321 B1 * 5/2004 Puchlerz ..... 124/44.5
6,782,881 B2 * 8/2004 Mizek et al. ..... 124/44.5
6,789,536 B1 9/2004 Summers
6,823,856 B2 11/2004 Rager

OTHER PUBLICATIONS

Whammy, downloaded on Jan. 30, 2007 from URL:http//spot-hogg.com/products_arrowrests_whammy.shtml.

* cited by examiner

*Primary Examiner*—John Ricci
(74) *Attorney, Agent, or Firm*—Warner Norcross & Judd LLP

(57) ABSTRACT

A drop-away arrow rest including an arrow support that rotates in a vertical plane about a horizontal axis parallel to of a supported arrow. The rest can include a bias member and a connector joined with an upward moving bowstring portion and/or a downward moving bowstring portion. The bias member urges the support to a support position and/or a rest position. Movement of a bowstring portion correspondingly moves the connector so that the connector moves the support about an axis that is substantially parallel to a supported arrow, thereby moving the support to at least one of a support position and a rest position. Optionally, an indicator indicates when the support is in the support position. Further optionally, the connector can be secured to a connector device defining an aperture and joined with a bowstring portion.

19 Claims, 8 Drawing Sheets

DROP-AWAY ARROW REST

This application claims benefit of U.S. provisional patent application 60/784,940, filed Mar. 23, 2006, which is hereby incorporated by reference.

BACKGROUND OF THE INVENTION

The present invention relates to an archery drop-away arrow rest and a related method of manufacture.

Most archery bows include an arrow rest that holds an arrow before it is shot from the bow. An increasingly common arrow rest is referred to as a "drop-away" arrow rest. This rest precisely and accurately positions the arrow when the bow (and thus, the bowstring) is at full draw, but drops rapidly forward and away from the arrow upon release of the bowstring. Accordingly, the rest does not to contact the arrow or the arrow's fletching and divert the arrow from its intended trajectory as the arrow is shot from the bow.

A variety of drop-away arrow rests exist. The common elements of such rests are: (a) an arrow support that holds the arrow shaft in a loaded position at full draw and subsequently drops forward or falls away forward (away from the archer/bowstring) to a relaxed position upon release of the bowstring; (b) a mechanism for moving the arrow support to the loaded position; and (c) a spring that moves the arrow support to the relaxed position upon release of the bowstring.

In moving between a loaded or cocked position and a relaxed position, most conventional rests pivot arcurately forward (away from the archer/bowstring) and downward, rotating about a horizontal axis that is itself perpendicular to the axis of a supported arrow shaft.

A recent, less conventional drop-away rest design, in which the arrow support drops in a different manner—specifically along a straight vertical path, is exemplified in U.S. Pat. No. 6,823,856 issued to Rager. There, the support is urged to a relaxed position by a spring. The support is secured with a cord to a downwardly moving portion of the bowstring. As the bowstring is drawn, the downwardly traveling portion pulls the cord and subsequently urges the arrow support vertically upward on a guide rod, against the force of the spring, until the arrow support is in a support position. When the bowstring is released, the spring forces the arrow support vertically downward, out of the way of the arrow.

Another drop-away rest is disclosed in U.S. Pat. No. 4,865,007 to Saunders. This rest includes a pivoting arm, a boss and a grooved quadrant block that pivots about a vertical axis. The arrow fits between the boss and the quadrant groove. When the bowstring is drawn then released, the arrow frictionally engages the groove of the block, which causes the block to rotate. After the guide block rotates about 180 degrees, it releases the pivoting arm, which thereby pivots and falls via gravity. With today's faster bows, however, the pivoting arm has difficulty falling fast enough so that it does not interfere with the shot arrow.

Although the aforementioned rests frequently perform satisfactorily, they suffer several shortcomings. First, the devices are somewhat complicated and require multiple parts, which can increase the weight of the rests. Second, the adjustability of many arrow supports is severely limited. Third, the support arms of many rests simply do not move fast enough out of the path of a shot arrow.

SUMMARY OF THE INVENTION

The aforementioned problems are overcome by an archery drop-away arrow rest including an arrow support that rotates in a vertical plane about a horizontal axis parallel to the axis of a supported arrow.

In one embodiment, the arrow rest includes an arrow support, a bias member, such as a spring, and a connector, such as a cord, which is connected to a downwardly moving portion of a bowstring of an archery bow. The spring urges the support to a rest position, which is generally out of the way of an arrow being shot from the bow. When the bowstring is drawn, the downwardly moving portion of the bowstring moves down, tensions the connector (working against the bias member) to urge the arrow support to a support position where it properly supports the arrow immediately before the arrow is shot. When the bowstring is released, the downwardly moving bowstring portion removes the tension in the connector, and the bias member rapidly moves the support out of the way of the arrow.

In another embodiment, the arrow rest includes an arrow support, a bias member, and a connector, which is connected to the support and an upwardly moving portion of the bowstring. The bias member biases the arrow support to a support position. When the bowstring of a bow is undrawn, the cord is slightly tensioned by the upwardly moving bowstring portion. The bias member can balance the force on the support to urge or hold the arrow support in a support position. When the bowstring is drawn, the upwardly moving bowstring moves upward, removing some, if not all, of the tension from the cord. Accordingly, the arrow support is in its supportive position, readying a loaded arrow for shooting. When the bowstring is released, the upwardly moving portion of the bowstring rapidly moves the connector, which in turn rapidly moves the support out of the way of the arrow.

In yet another embodiment, the arrow support moves through a range of motion to achieve a support position. The range of motion is limited by a stop which can define the maximum upward travel limit of the arrow support. Optionally, the arrow rest includes an indicator, for example, an LED, which illuminates when the arrow support is at a desired location, for example, when the arrow support is at its maximum upward travel limit defined by the stop.

In a further embodiment, at least one of the structure for mounting the rest assembly to the bow, the housing body for the rest mechanism and the arrow support is constructed from magnesium or a magnesium alloy.

In yet a further embodiment, a method is provided to form at least one of a structure for mounting the rest to a bow, a housing body for the rest and the arrow support by a casting process, such as die-casting, investment casting, thixotropic molding or injection molding.

The drop-away arrow rest of the present invention provides a simple and efficient mechanism to support a ready-to-shoot arrow relative to a bow, and rapidly move a support of the rest out of the way of the arrow as it is shot. Where the arrow rest is optionally constructed from magnesium or magnesium alloy, the rest can provide further vibration dampening for the archery bow to which the rest is mounted.

These and other objects, advantages and features of the invention will be more readily understood and appreciated by reference to the detailed description of the invention and the drawings.

DETAILED DESCRIPTION OF THE INVENTION

I. Construction and Components

Figure 1:
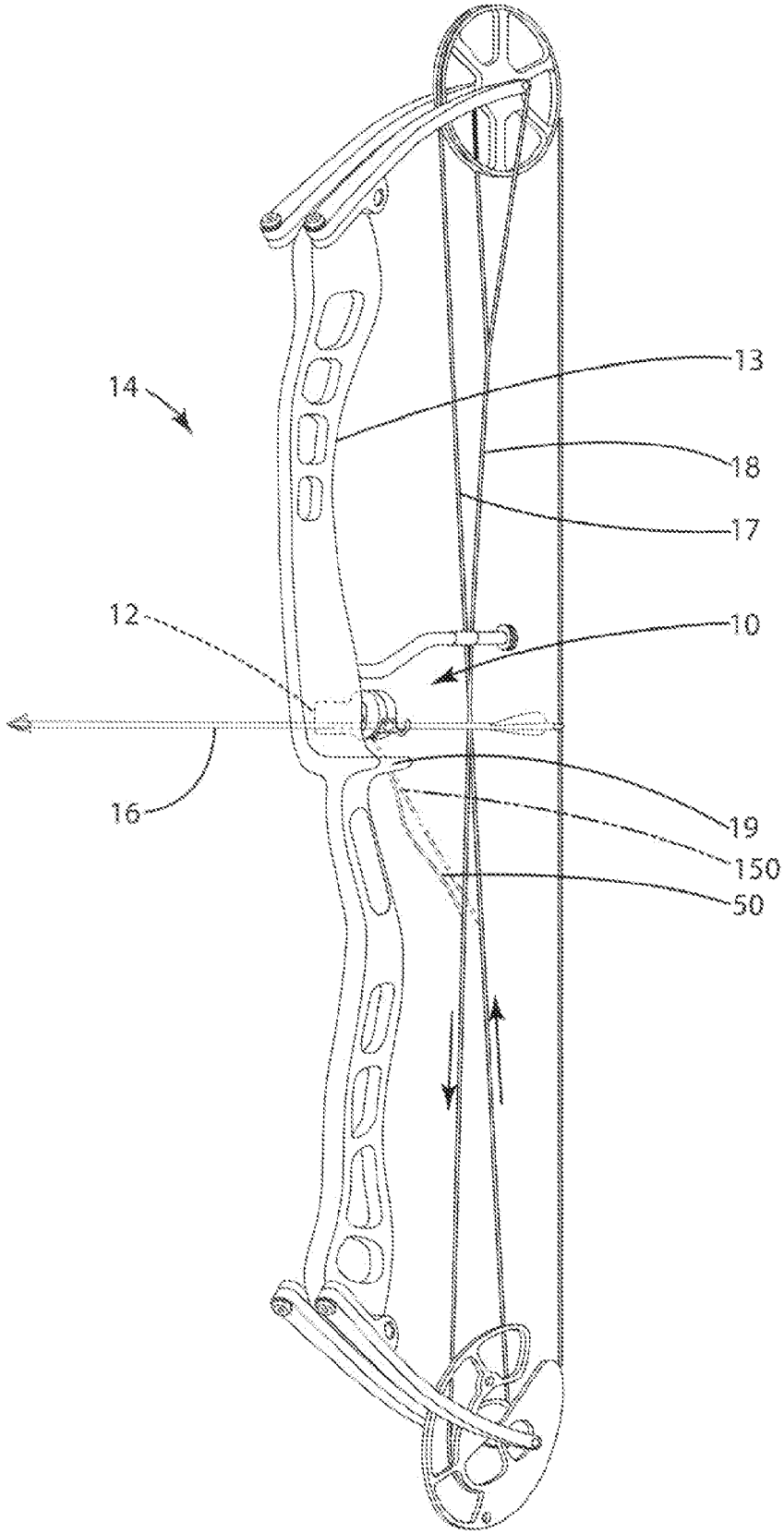
FIG. 1 is a perspective view of a bow incorporating an embodiment of the arrow rest of the present invention.

A drop-away arrow rest constructed in accordance with one embodiment of the invention is illustrated in FIGS. 1-7 and generally designated 10. The drop-away arrow rest 10 generally includes a mounting bracket 12, a movable portion 20 which connects the housing 30 to the bracket, a movable support arm 40, and a connector 50 which operably couples the support arm 40 to a bowstring of a bow to which the rest is mounted. For purposes of this disclosure, the drop-away arrow rest is described in connection with an archery bow, however, the assembly is well suited for use with any projectile shooting device.

Figure 4:
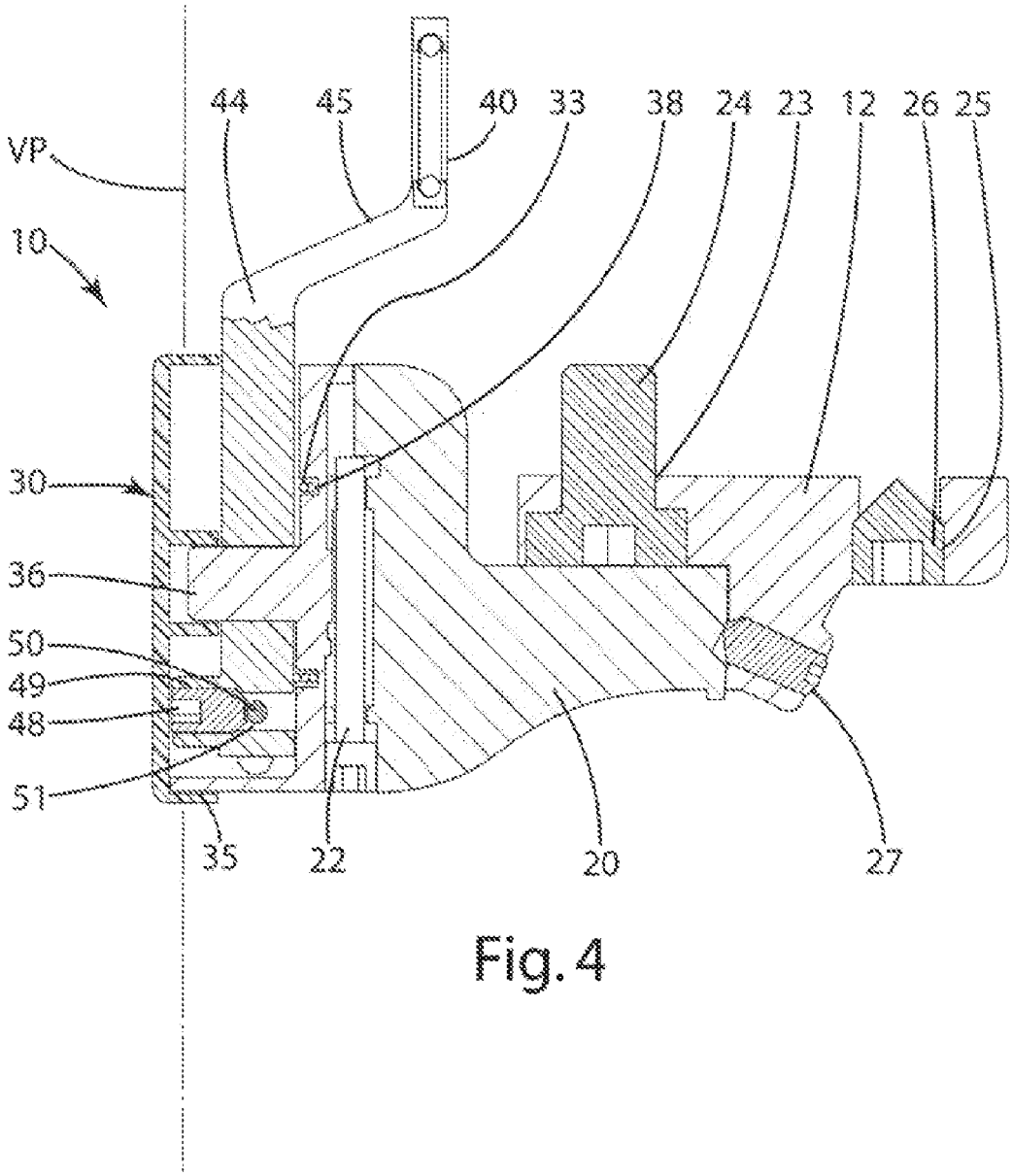
FIG. 4 is a sectional view of the arrow rest taken along lines 4-4 of FIG. 3.

The drop-away rest 10, and specifically the bracket 12, is joined with an archery bow riser 13. This can be done with a variety of constructions. For example, the bracket 12 can define an aperture 23 through which a conventional fastener, such as the screw 24 is positioned and optionally threaded (FIG. 4). This fastener 24 can thread into a similarly threaded aperture in the bow riser 13 to secure the bracket 12 to the riser. A second locking screw 26 can be threaded through a second bracket aperture 25 in the rest to further secure the rest in the desired position.

Optionally, this configuration to secure the bracket 12 to the riser 13 can be modified. For example, the aperture 23 can form a longitudinal slot extending from the front of the bracket 12 to the rear of the bracket. In this construction, the fastener 23 and second aperture 25 can be deleted from the construction. With the elongated slot, the fastener 24 could simply be installed on the riser 13 and the position of the slot relative to the fastener 24 could be adjusted to provide fore and aft movement, and subsequent adjustment of the bracket 12 and subsequently the arrow rest 10. A variety of other constructions can be substituted for the aforementioned construction to accommodate various hole patterns in the risers of bows from different manufacturers.

Figure 2:
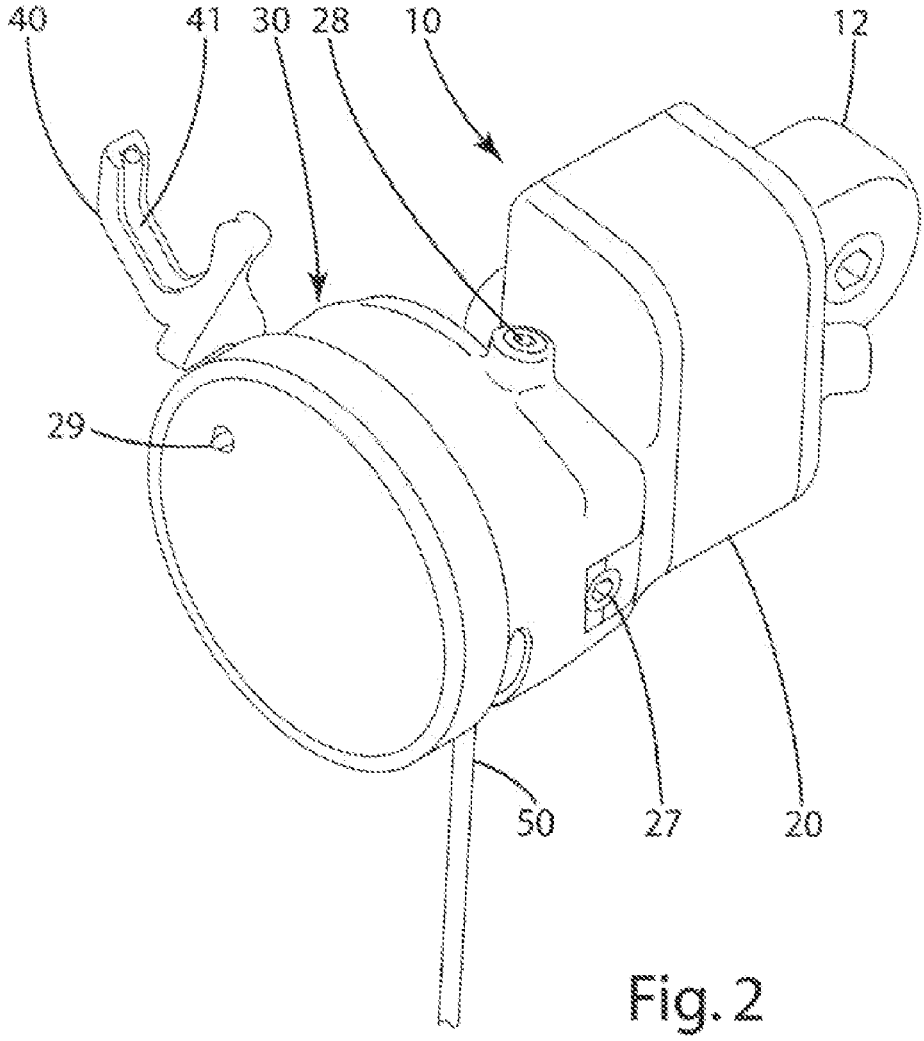
FIG. 2 is a rear perspective view of the arrow rest.
Figure 3:
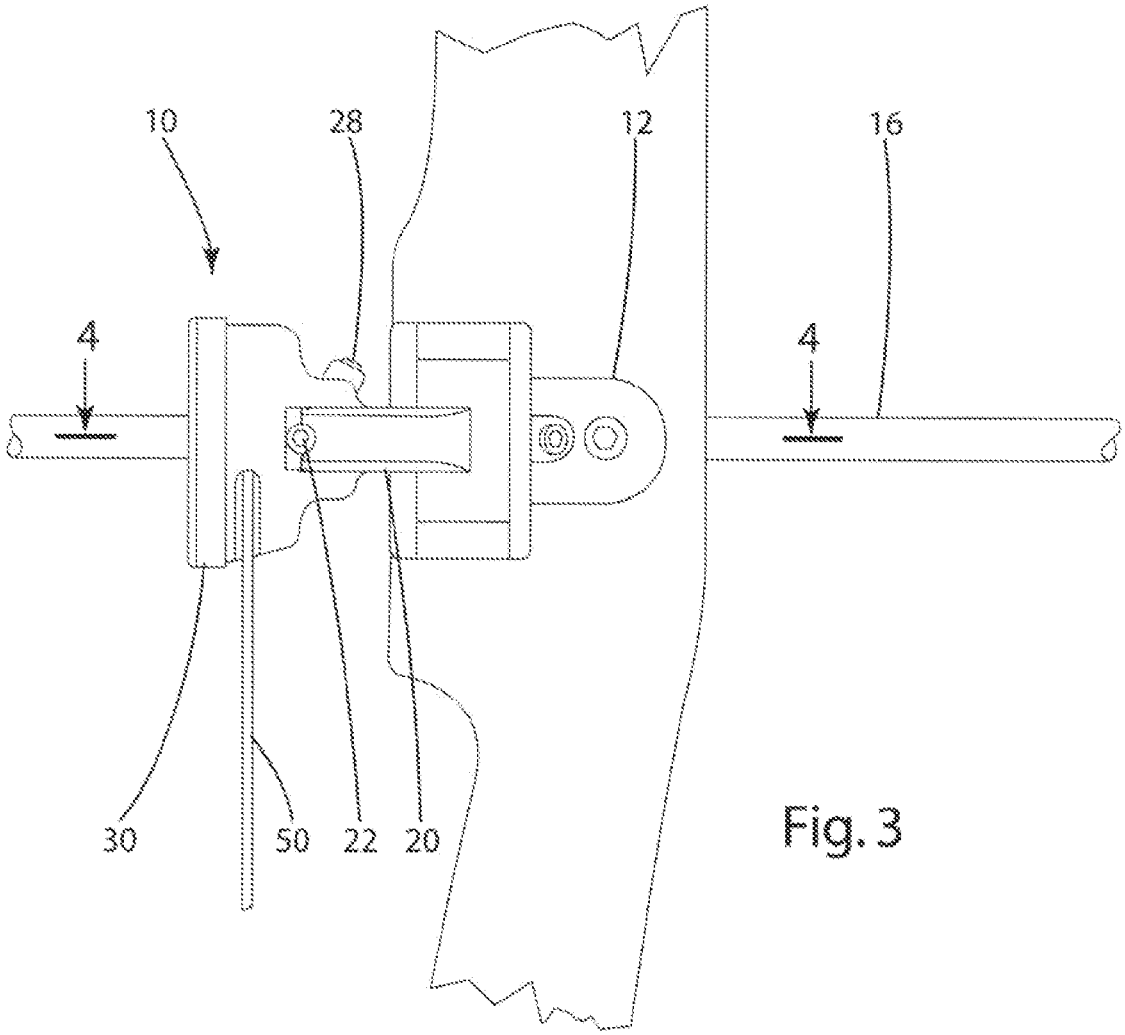
FIG. 3 is a side view of the arrow rest.

Referring to FIGS. 2-4, the arrow rest can include elevation and windage adjustment mechanisms so that a user can adjust the drop-away rest horizontally and vertically to tune the bow and ensure that the flight path and stability of the arrow during flight is maximized. Specifically, the arrow rest is adjustable in elevation by vertical movement between the bracket 12 (and thus the bow riser 13) and the movable portion 20. The elevation adjustment can be controlled by moving the movable portion 20 up and down relative to the bracket 12 and fixedly securing the two components together by tightening the locking screw 27. This elevation adjustment mechanism can be substituted with any other desirable elevation system.

The windage adjustment mechanism includes an adjustment screw 22 and a securing screw 28. By rotating the adjustment screw 22, the housing 30 moves relative to the movable portion 20. To secure the housing 30 in a fixed position relative to the movable portion 20, the locking screw 28 engages the movable portion 20. Other configurations for adjusting the elevation and windage of the arrow rest relative to the bowstring and/or riser can be used as desired. Further, graduation marks can be included on the bracket 12, the movable portion 20 and/or the housing 30 to provide reference points or features when adjusting the elevation and windage of the arrow rest.

Figure 5:
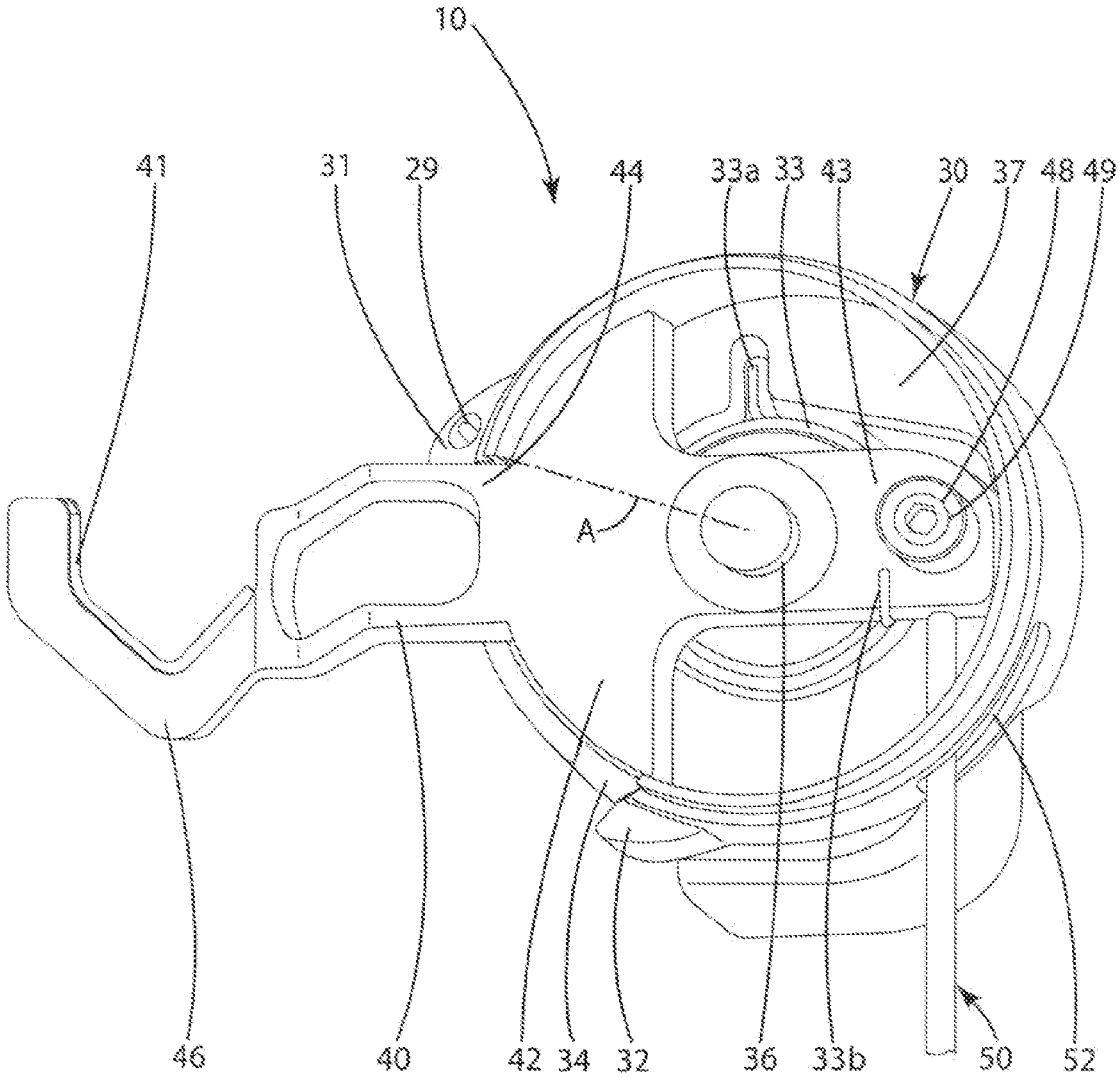
FIG. 5 is a rear perspective view of the arrow rest showing its internal components.

As shown in FIGS. 3-5, the housing 30 can define an internal compartment 37 within which a variety of components are disposed. The housing can further include an optional cover 35, which as shown is threaded onto a portion of the housing 30. Optionally, the cover 35 can be secured to the housing 30 via fasteners such as screws, rivets, adhesives or other suitable constructions.

The housing 30 can also define a relief, recess, aperture or slot 34 each referred to generally as a "recess" herein, in which the support arm 40 moves. The recess 34 can be constructed so that when the cover 35 is threaded onto the housing 30, the cover does not interfere with the movement of the arm 40 in the recess 34.

Adjacent the recess 34 are upward dead stop 31 and downward dead stop 32. These stops can be constructed of the same material as the housing. Alternatively, the stops can be constructed from an elastomeric or dampening material, such as rubber or plastic, with the stop via an adhesive or other fastener to the housing. The upward 31 and downward 32 stops can define the maximum upward position of the arrow support and maximum downward position of the arrow support, respectively.

Referring to FIG. 5, optionally, the arrow rest 10 can include a visual indicator 29, such as a light emitting diode (LED) that indicates when the arrow support 40 is in the maximum upward position. This indicator can be shrouded so as not to alert the game being hunted or materially affect aiming of the archery bow to which the rest is attached. This visual indicator 29 can be included on the housing 30 or the stop 31, and can optionally be in electrical communication with a switch (not shown) which when contacted actuates the indicator. Optionally, where the stop 31 includes the indicator, the arrow support 40 can be manufactured from an electrically non-conducting material of sufficient strength and durability, for example a polycarbonate or fiber-filled nylon. Further optionally, where the arrow support 40 is manufactured from metal, such as magnesium or magnesium alloy, electrical isolation of this component from the stop 31 can be provided.

Alternatively, the cover 35 can include the indicator (FIG. 2) and a switch. The switch can be configured to engage a protrusion or other actuator (not shown) on the arm 40 to indicate when the arm 40 is in the maximum upward position. The cover including this indicator and switch can be offered as an upgrade to the arrow rest.

Referring to FIGS. 3-5, the housing also houses an axle 36. The axle protrudes into the internal compartment 37. The axle 36 can be integrally formed with the remainder of the housing 30; however, the axle also can be a threaded cylindrical or other geometric-shaped component that is threaded into a corresponding hole defined by the housing 30. Other constructions for securing the axle 36 to the housing can be used as desired.

In general, the axle is aligned with a rest axis A. When the rest 10 is installed on the riser, the axis A is parallel to an axis of an arrow 16 (FIG. 3) when the support arm 40 is in the support position (shown in FIGS. 2-5). With the support arm 40 secured to this axle 36 rotating about this axis A, the arm rotates within the vertical plane VP (FIG. 4) when the bow is drawn or shot by an archer on level ground.

The drop-away arrow rest 10 further includes a biasing member 33 which is housed in the housing 30. As shown in FIGS. 4-5, the housing 30 can define an annular recess 38 in which a coil spring 33 is positioned (FIG. 4). The coil spring can include a first end 33*a* and a second end 33*b*. The first end 33*a* can include a tang that engages a recess defined by the housing. The second end 33*b* can include a hook portion which engages a portion of the arrow support 40 (FIG. 5). Although the bias member 33 is shown as a coil spring, other springs such as leaf springs can be included to move the arrow support 40.

The arrow rest 10 also includes an arrow support 40. As shown in FIGS. 4 and 5, the arrow support is rotatably mounted on the axle 36. Alternatively, the support and axle could be one component (not shown), which rotate together relative to the housing. The support 40 in FIGS. 4-5 includes a counter weight or guide portion 42, a primary arm 44 and a secondary arm 43. The counter weight portion 42 is in the form of a partial disc or semi-circle matching the compartment 37 contours; however, this counter weight can be constructed in any configuration as desired. Primary arm 44 extends away from the axle 36 and is generally disposed through the housing recess 34. The primary arm 44 transitions to an offset arm 45 which extends at an angle, forward toward the front of the arrow rest 10. The offset arm 45 transitions to a support notch 46, which as shown, can generally be in the shape of a "V" or "U". The notch 46 generally can be immovable relative to the remainder of the support arm.

The bottom of the notch 46 optionally can be outfitted with a vibration isolation member 41. This vibration isolation member 41 can reduce the potential for noise being generated when an arrow 16 is positioned in the notch 46. This member 41 can also reduce the potential for unintentional movement being imparted to the arrow after the arrow is positioned on the arrow support 40. The isolation member can be constructed from an elastomeric or synthetic material such as rubber or plastic, which is adhered to the notch 46. Alternatively, the notch 46 can be molded in a two-shot mold so that the member 41 is a different material that forms a part of the notch 46.

The arrow support 40 can also include a connector assembly 49. As shown in FIG. 4, the connector assembly 49 includes a screw 48 which is received in an aperture 49 defined by the support 40 and particular, the secondary arm 43. The screw aperture intersects with a connector aperture 51. When the connector 50 is inserted into the connector aperture 51, the connector 50 can be engaged and held by the screw 48 to secure the connector 50 in a fixed relation relative to the arm.

The connector 50 shown in FIGS. 1 and 5 extends through a connector hole 52 and exits to the housing 30. The connector in the embodiment shown in FIG. 1 is connected to the downwardly moving bowstring portion 18. By downwardly moving, it is meant that as the bowstring is drawn by an archer, that downward, moving portion of the string moves downward. Conversely, the upwardly moving portion of the bowstring 17 is that portion which moves upward as the bow is drawn by an archer.

The connector 50 as shown is an elastic cord. Optionally, that connector can be substituted with any string, wire, web, rubber band, hydraulic or other linkage joined with a desired portion of the bowstring, provided that the connector operably joins the arrow support 40 to the bowstring in such a manner that movement of the bowstring moves the support 40.

Figure 9:
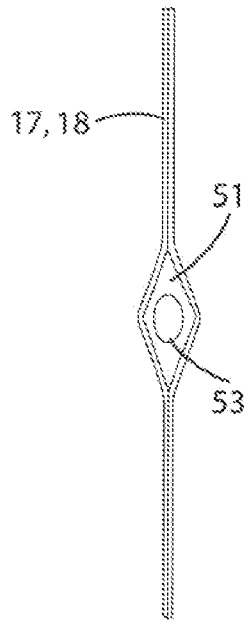
FIG. 9 is a front view of a device that connects a connector of the arrow rest to a bowstring.

An optional device 51 that can connect the connector 50 to the bowstring is illustrated in FIG. 9. This device 51 defines an aperture 53 that is essentially diamond shaped, but which can be of other geometric shapes. Device 51 can include grooves or recesses in its walls so that when it is inserted between the strands of a bowstring cable 17 or 18, the strands of the bowstring rest within the grooves and secure the device 51 in a fixed position. Servings may be wrapped around the bowstring portion 17 or 18 to further immobilize movement of the device 51 relative to the string portion 17 or 18. The connector 50 can be inserted through the aperture 53 and tied so that the resulting knot cannot fit through the aperture 53. In this manner, the connector can be pulled taut by the respective bowstring portion 17 or 18 in its intended motion as described below. Alternatively, the end of the connector 50 can be melted or joined with an object that is larger than the aperture 53 to provide the same effect. Optionally, the device 51 can be constructed of an elastomeric or other synthetic material.

Figure 6:
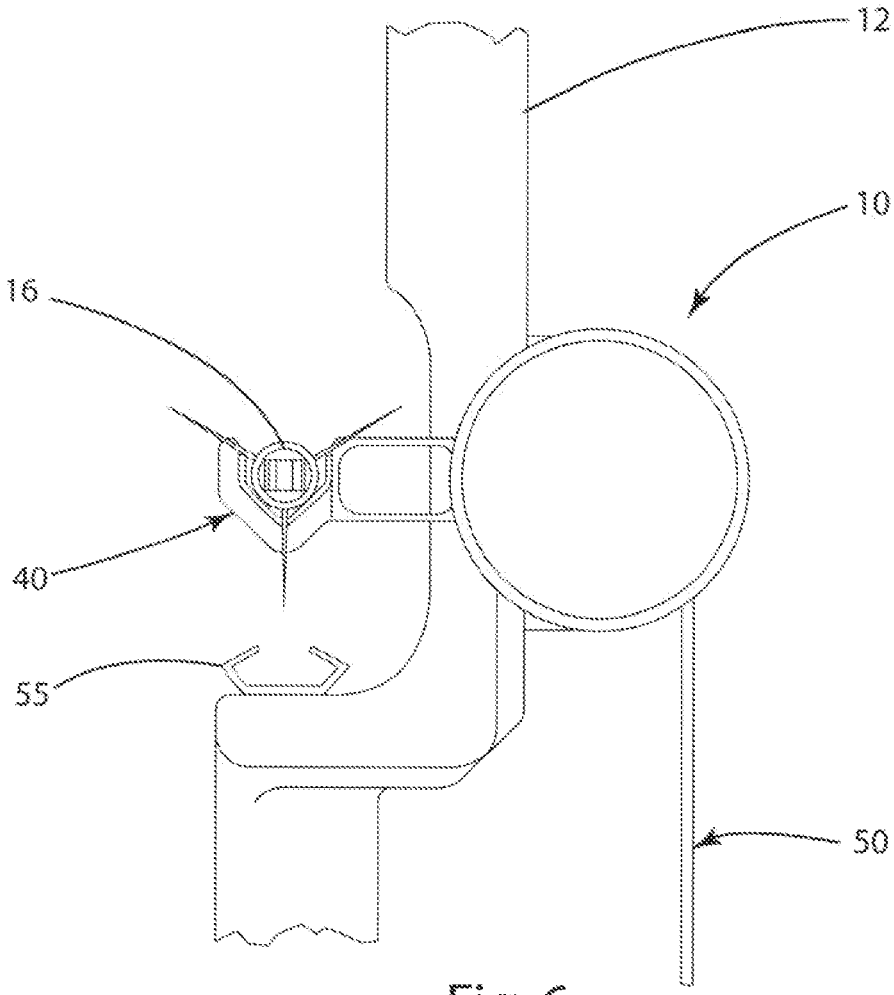
FIG. 6 is a rear view of the arrow rest supporting an arrow.
Figure 7:
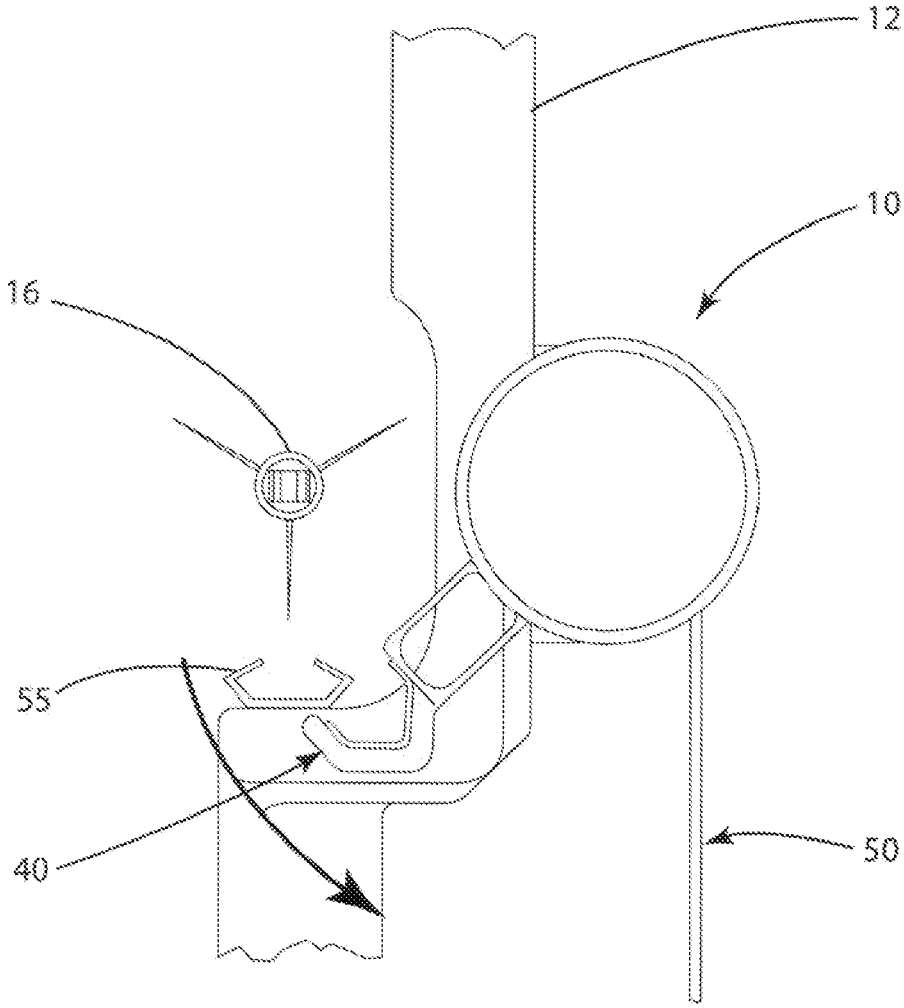
FIG. 7 is a rear view of the arrow rest arrow support in the downward position, freeing the arrow for flight.

Shown in FIGS. 6 and 7 is an optional holder 55 that can be used in connection with an arrow rest 10. The arrow holder 55 can be adhesively secured to the shelf of the riser 13. The holder can include one or more opposing, resilient flexible fingers that engage the arrow shaft 16 to secure it in a ready position when the bow is in an undrawn state. The holder can be constructed from a variety of materials, such as rubber, plastic and other suitable synthetic compounds.

The housing, support arm, bracket and other components of the drop away rest 10 can be constructed from a variety of metals, plastics or other synthetic materials or combinations of the foregoing. Where one or more components are constructed from magnesium or an magnesium alloy, these components can be manufactured using a casting process such as die casting, investment casting or thixotropic molding. Optionally, the casting can be performed using a four-slide die casting methodology as the application requires. Where the material used for one or more components of the rest is a suitable plastic, such as polycarbonate, the components can be manufactured via injection molding.

II. Operation of the Drop-Away Arrow Rest

Operation of the drop-away arrow rest 10 will now be described in connection with FIGS. 1 and 6-7. In general, the drop-away arrow rest moves the arrow support 40 from a support position, in which an arrow to be shot from the bow is fully supported and readied for shooting (FIG. 6), to a rest position when the bowstring moves, so that the support 40 is moved out of the path or trajectory of the arrow 16 as the arrow is released from the bowstring. Moving from the support position to the rest position, the arrow support 40 undergoes C-axis movement, wherein the arrow support rotates in about a horizontal axis that is parallel to the axis of the supported arrow 16. Further, the arrow support 40 can rotate about the axis A in the vertical plane VP shown in FIG. 4 when the bow is shot by an archer on level ground.

When the archery bow to which the arrow rest 10 is in the undrawn state shown in FIG. 1, the connector 50 is generally relaxed, and the bias member 33 exerts a force on the secondary arm 43 so that the support 40 is in its rest position.

When an archer draws the bowstring, the downward moving bowstring 18 to which the connector 50 is secured begins to move downward in the direction of the arrow in FIG. 1. Accordingly, as the connector moves downward it becomes taut and rotates the support arm 40 clockwise about the axis A toward the position shown in FIG. 5. During this movement, the arrow 16 is captured in the notch 46 of the arrow support 40 and the arrow support 40 continues its upward movement until it achieves its maximum upward position, which can be limited by the upward stop 31. If the arrow was previously engaged/held by the arrow holder 55 (FIGS. 6-7), the arm 40 pulls the arrow 16 out from the capturing fingers of the holder and continues to raise the arrow. If equipped with an indicator 29, the indicator illuminates to inform the archer that the support 40 has achieved its maximum upward movement and the bowstring is fully drawn.

The arrow support 40 is in the position shown in FIGS. 5 and 6 while the bowstring is in its fully drawn state. The biasing member 33 is also biased, but because the force generated by the connector 50 overcomes the force generated by the bias member 33, the support 40 remains in the support position shown in those figures.

When the bowstring is released, the downwardly moving bowstring portion 18 reverses its direction and moves upward, thereby removing the tension in the connector 50. Accordingly, the bias member 33, which is engaged with the secondary arm 43, rapidly urges the arrow support 40 to the position shown in FIG. 7. During the release of the bowstring, the support 40 is forced to rapidly rotate by the bias member 33 about the axis A in the vertical plane VP, optionally until the primary arm 44 engages the downward stop 32 to stop the rotation. The movement of the support 40 is immediate and quick enough so that the entire support 40 is out of the path of the arrow 16 as shown in FIG. 7. Accordingly, the arrow can fly true without being affected by the arrow rest.

III. First Alternative Embodiment

Figure 8:
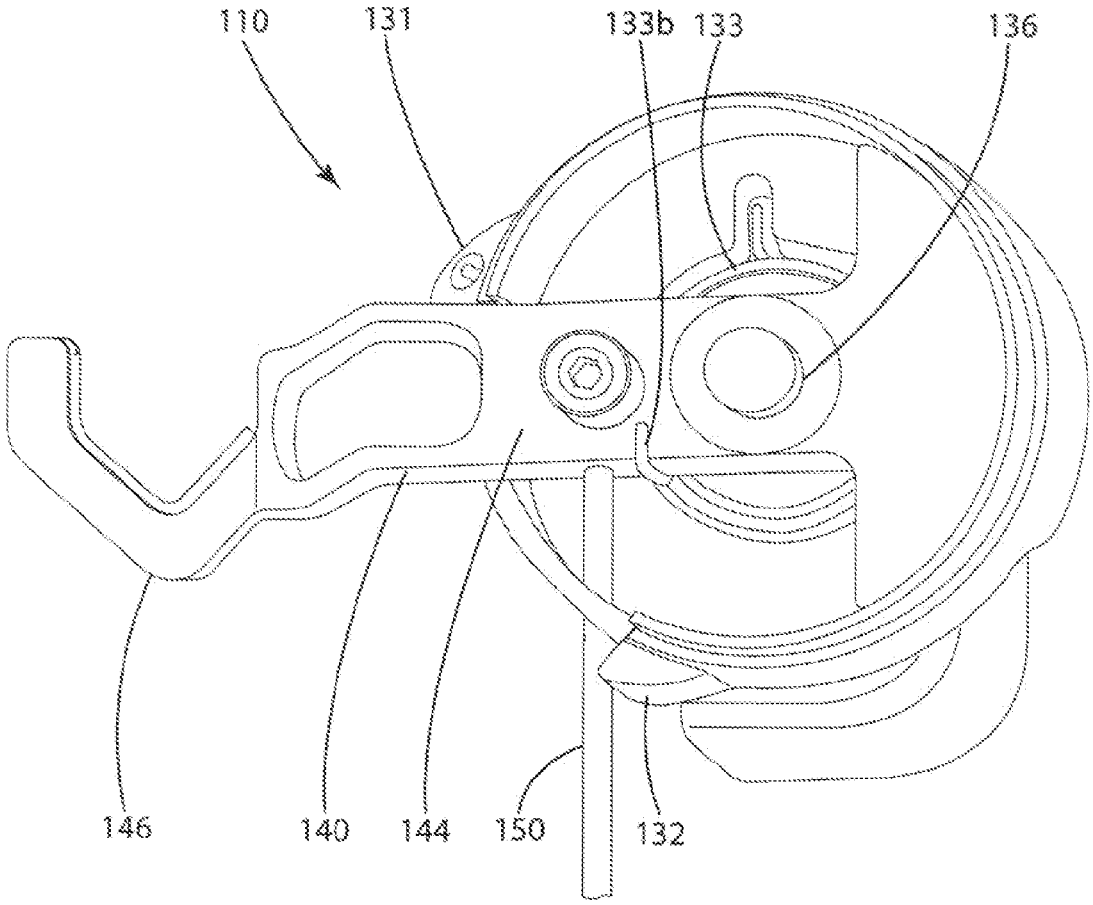
FIG. 8 is a rear perspective view of a first alternative embodiment of the arrow rest showing the internal components.

In another embodiment, the actuation of the arrow support can be modified so that the arrow support movement is actuated by the upwardly moving bowstring portion 18 in FIG. 1. With reference to FIG. 8, this alternative embodiment includes many of the same features of the embodiment described above. The primary difference is the orientation of the connector 150 and bias member 133 relative to the arrow support 400 and the axle 136. As shown, the connector 150 is joined with the arrow support primary arm 144. The bias member 133 exerts an upward force on the arm 140 to urge the arm into or toward engagement with the upward stop 131.

With reference to FIGS. 1 and 8, the operation of this first alternative embodiment will be described. When the bow 14 is in an undrawn state, the upwardly moving bowstring portion 17 is in its downward most position. The connector 150 is in this embodiment is attached to the upwardly moving bowstring, as shown in phantom lines in FIG. 1, and this connector 150 is taut. The force of the bias element 133, balances the force exerted by the connector 150 on the arm 140 so that the arm 140 remains in the support position shown in FIG. 8. When the bow 14 is drawn by an archer, the upwardly moving cable 17 moves upwardly. Accordingly, the connector 150 becomes slightly less taut or slack. The arrow support remains in the support position shown in FIG. 8.

After the bowstring is released by an archer, the upwardly moving bowstring portion 17 moves rapidly downward towards its downward most position. In so doing, it exerts significant inertia on connector 150 so that the connector 150 pulls the arrow support 140 downward toward the downward stop 132. Accordingly, the arrow support is moved out of the path of the arrow as it exits the bow as shown in FIG. 7. When the upwardly moving bowstring portion reaches its downward most position after the bow is shot, the arrow support 140 is urged by the bias member 133 and returns to the support position.

Alternatively, the connector 150 can be joined with the upwardly moving cable 17 so that when the upwardly moving cable 17 is in its downward most position (when the bow is in an undrawn state), the connector 150 is taut and the force transmitted through the connector 150 is significant enough to overcome the force exerted on the support 140 by the bias member 133. Accordingly, when the archery bow 140 is in its undrawn state, the connector 150 pulls the arrow support 140 to its rest position.

Upon drawing the bow, however, the upwardly moving portion 17 relieves the tension in the connector 150. Accordingly, the bias member 130 urges the arrow support 140 to a support position. When the bowstring is released, the upwardly moving bowstring portion 17 moves toward its downward most position to move the arrow support out of the way of the arrow, similar to the position shown in FIG. 6.

Regardless of how the connector 150 is connected to the bowstring portions, the arm 140 can undergo C axis movement about axis A. The arrow support 140 can rotate about an axis A that is substantially parallel to the axis of the arrow 16 when the arrow is supported on the support 140.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A drop-away arrow rest for a bow, the bow including a bowstring having an upward moving bowstring portion and a downward moving bowstring portion, the rest comprising:

a bracket configured to attach to the bow;

an arrow support operably coupled to the bracket, the arrow support movable from a support position to a rest position, the arrow support having a rest axis that is substantially parallel to an axis of an arrow supported on the arrow support when the support is in the support position, the arrow support rotatable about the rest axis in a substantially vertical plane;

a bias member engaging the avow support to position the avow support in at least one of the support position and the rest position; and a connector that connects the avow support to at least one of the upward moving bowstring portion and the downward moving bowstring portion, the connector providing an opposing force to a force created by the bias member about the rest axis when the support is in at least one of the support position and the rest position, wherein movement of at least one of the upward moving bowstring portion and the downwardly moving bowstring portion moves the connector, thereby rotating the support about the rest axis to at least one of the support position and the rest position within the substantially vertical plane, wherein the arrow support engages the arrow and supports the arrow in the support position when the archer draws the bow, wherein the arrow support disengages the arrow when the bow is in an undrawn state.

2. A drop-away arrow rest for a bow, the bow including a bowstring having an upward moving bowstring portion and a downward moving bowstring portion, the rest comprising:

a bracket configured to attach to the bow;

an arrow support operably coupled to the bracket, the arrow support movable from a support position to a rest position, the arrow support having a rest axis that is substantially parallel to an axis of an arrow supported on the arrow support when the support is in the support position, the arrow support rotatable about the rest axis in a substantially vertical plane;

a bias member engaging the arrow support to position the arrow support in at least one of the support position and the rest position; and a connector that connects the arrow support to at least one of the upward moving bowstring portion and the downward moving bowstring portion, the connector providing an opposing force to a force created by the bias member about the rest axis when the support is in at least one of the support position and the rest position, wherein movement of at least one of the upward moving bowstring portion and the downwardly moving bowstring portion moves the connector, thereby rotating the support about the rest axis to at least one of the support position and the rest position within the substantially vertical plane, wherein the bias member urges the arrow support to the support position, wherein the connector connects the arrow support arm with the upward moving bowstring portion, wherein movement of the upwardly moving bowstring portion moves the connector so that the arrow support is in the support position when the bow is drawn by an archer.

3. The drop-away arrow rest of claim 2 wherein the upwardly moving bowstring portion rapidly moves to a downward most position when the archer shoots the bow, wherein the connector rapidly moves the arrow support from the support position to the rest position, rotating the support about the rest axis in the substantially vertical plane.

4. The drop-away arrow rest of claim 3 wherein the arrow support includes an arm extending away from the rest axis, the arm terminating in at least one of a V-shaped and a U-shaped notch in which the arrow is supported.

5. A drop-away arrow rest for a bow, the bow including a bowstring having an upward moving bowstring portion and a downward moving bowstring portion, the rest comprising:

a bracket configured to attach to the bow;

an arrow support operably coupled to the bracket, the arrow support movable from a support position to a rest position, the arrow support having a rest axis that is substantially parallel to an axis of an arrow supported on the arrow support when the support is in the support position, the arrow support rotatable about the rest axis in a substantially vertical plane;

a bias member engaging the arrow support to position the arrow support in at least one of the support position and the rest position;

a connector that connects the arrow support to at least one of the upward moving bowstring portion and the downward moving bowstring portion, the connector providing an opposing force to a force created by the bias member about the rest axis when the support is in at least one of the support position and the rest position; and an upward stop, the biasing member biasing the arrow support against the upward stop when the arrow support is in the support position, wherein movement of at least one of the upward moving bowstring portion and the downwardly moving bowstring portion moves the connector, thereby rotating the support about the rest axis to at least one of the support position and the rest position within the substantially vertical plane.

6. A drop-away arrow rest for a bow, the bow including a bowstring having an upward moving bowstring portion and a downward moving bowstring portion, the rest comprising:

a bracket configured to attach to the bow;

an arrow support operably coupled to the bracket, the arrow support movable from a support position to a rest position, the arrow support having a rest axis that is substantially parallel to an axis of an arrow supported on the arrow support when the support is in the support position, the arrow support rotatable about the rest axis in a substantially vertical plane;

a bias member engaging the arrow support to position the arrow support in at least one of the support position and the rest position;

a connector that connects the arrow support to at least one of the upward moving bowstring portion and the downward moving bowstring portion, the connector providing an opposing force to a force created by the bias member about the rest axis when the support is in at least one of the support position and the rest position; and a housing that defines a recess, the support moving from the support position to the rest position within the recess, wherein movement of at least one of the upward moving bowstring portion and the downwardly moving bowstring portion moves the connector, thereby rotating the support about the rest axis to at least one of the support position and the rest position within the substantially vertical plane.

7. A drop-away arrow rest for a bow, the bow including a bowstring having an upward moving bowstring portion and a downward moving bowstring portion, the rest comprising:

a bracket configured to attach to the bow;

an arrow support operably coupled to the bracket, the arrow support movable from a support position to a rest position, the arrow support having a rest axis that is substantially parallel to an axis of an arrow supported on the arrow support when the support is in the support position, the arrow support rotatable about the rest axis in a substantially vertical plane;

a bias member engaging the arrow support to position the arrow support in at least one of the support position and the rest position; and a connector that connects the arrow support to at least one of the upward moving bowstring portion and the downward moving bowstring portion, the connector providing an opposing force to a force created by the bias member about the rest axis when the support is in at least one of the support position and the rest position, wherein movement of at least one of the upward moving bowstring portion and the downwardly moving bowstring portion moves the connector, thereby rotating the support about the rest axis to at least one of the support position and the rest position within the substantially vertical plane, wherein the connector connects the arrow support with the downward moving bowstring portion, wherein the bias member urges the support to the rest position, wherein movement of the downward moving bowstring portion moves the connector and subsequently moves the support around the rest axis within the substantially vertical plane to the support position when an archer draws the bow.

8. The drop-away avow rest of claim 7 wherein the arrow support rotates about an axle that is aligned with the rest axis, wherein the bias member is concentrically disposed around at least a portion of the axle.

9. A drop-away arrow rest for a bow, the bow including a bowstring having an upward moving bowstring portion and a downward moving bowstring portion, the rest comprising:

a bracket configured to attach to the bow;

an arrow support operably coupled to the bracket, the arrow support movable from a support position to a rest position, the arrow support having a rest axis that is substantially parallel to an axis of an arrow supported on the arrow support when the support is in the support position, the arrow support rotatable about the rest axis in a substantially vertical plane;

a bias member engaging the avow support to position the avow support in at least one of the support position and the rest position;

a connector that connects the arrow support to at least one of the upward moving bowstring portion and the downward moving bowstring portion, the connector providing an opposing force to a force created by the bias member about the rest axis when the support is in at least one of the support position and the rest position; and an indicator, the indicator engaged by the arrow support and illuminating when the arrow support is in the support position when an archer draws the bowstring, wherein movement of at least one of the upward moving bowstring portion and the downwardly moving bowstring portion moves the connector, thereby rotating the support about the rest axis to at least one of the support position and the rest position within the substantially vertical plane.

10. A drop away arrow rest for an archery bow, the bow including a bowstring having an upward moving portion and a downward moving portion, the rest comprising:

a bracket;

a housing adjustably joined with the bracket, the housing defining an internal compartment and a recess, the housing including a stop adjacent the recess;

an axle at least partially positioned in the internal compartment, the axle including an axis aligned substantially in parallel with an arrow loaded in the bow;

a support mounted to the axle, the support including an arrow supporting portion, the support rotatable about the axis and at least partially in the recess from a support position, in which the support engages the stop and supports the arrow loaded in a readied state for shooting from the bow, to a rest position;

a bias member urging the support toward the stop;

a connector joined with the support and the upward moving bowstring portion, the connector moving the support around the axis from the support position to the rest position when the arrow is shot from the bow by an archer.

11. The drop away arrow rest of claim 10 comprising a cover operably coupled to the housing, the cover including an indicator which indicates when the support is in the support position.

12. The drop away arrow rest of claim 10 wherein at least one of the bracket, housing, support, and axle are constructed from at least one of magnesium and a magnesium alloy.

13. The drop away arrow rest of claim 10 comprising a connector device, the connector device defining an aperture through which the connector is positioned, the connector device defining grooves that are engaged by strands of the upward moving bowstring portion.

14. The drop away arrow rest of claim 10 wherein the axle is integrally formed with the housing.

15. The drop away avow rest of claim 10 wherein the support includes a primary arm extending away from the axle, the support terminating in an arrow notch, the connector connected to the primary arm between the arrow notch and the axle.

16. A drop away arrow rest comprising:

a bracket securable to an archery bow;

a support joined with the bracket, the support operable in a support mode in which the support supports an avow in a readied state for shooting from the archery bow, and a rest mode in which the support is removed from a path of the arrow as it shoots from the archery bow, the support rotating around an axis that is substantially parallel to the avow in the readied state when the support transitions from the support mode toward the rest mode;

a bias member that engages and urges the support toward the support mode; and a connector joined with the support and joined with an upwardly moving bowstring portion of the archery bow, wherein the upwardly moving bowstring portion moves the connector and the support as the avow shoots from the archery bow so that the support transitions from the support mode to the rest mode.

17. The drop away avow rest of claim 16 comprising a stop limit that engages the support when the support is in the support mode and the arrow is in the readied state.

18. The drop away arrow rest of claim 16 comprising a housing defining a recess, the support moving in the recess as the support transitions from the support mode to the rest mode.

19. The drop away arrow rest of claim 16 comprising an indicator which the support engages when the support is in the support mode to alert an archer that the support is in the support mode.

* * * * *

UNITED STATES PATENT AND TRADEMARK OFFICE

CERTIFICATE OF CORRECTION

PATENT NO. : 7,597,095 B2
APPLICATION NO. : 11/690418
DATED : October 6, 2009
INVENTOR(S) : Grace, Jr. et al.

It is certified that error appears in the above-identified patent and that said Letters Patent is hereby corrected as shown below:

Column 8, Claim 1, Line 48
"avow" should be --arrow--

Column 8, Claim 1, Line 49
"avow" should be --arrow--

Column 8, Claim 1, Line 51
"avow" should be --arrow--

Column 11, Claim 8, Line 4
"avow" should be --arrow--

Column 11, Claim 9, Line 19
"avow" should be --arrow--

Column 11, Claim 9, Line 20
"avow" should be --arrow--

Column 12, Claim 15, Line 20
"avow" should be --arrow--

Column 12, Claim 16, Line 28
"avow" should be --arrow--

Column 12, Claim 16, Line 33
"avow" should be --arrow--

Column 12, Claim 16, Line 40
"avow" should be --arrow--

Signed and Sealed this

Nineteenth Day of January, 2010

David J. Kappos

David J. Kappos
*Director of the United States Patent and Trademark Office*